US005927544A

United States Patent [19]

Kanoh et al.

[11] Patent Number: 5,927,544

[45] Date of Patent: Jul. 27, 1999

[54] VENDING MACHINE FOR ENCASED RECORDING MEDIA

[75] Inventors: Chiyuki Kanoh; Futaba Komatsu, both of Nagano-ken, Japan

[73] Assignee: Nippon T.M.I. Co., Ltd., Nagano-ken, Japan

[21] Appl. No.: 08/845,157

[22] Filed: Apr. 21, 1997

[51] Int. Cl.[6] ..... G07F 7/08; G07F 11/62

[52] U.S. Cl. ..... 221/90; 211/169; 194/906; 312/901

[58] Field of Search ..... 194/906; 221/89, 221/90; 364/479.12, 479.13, 479.4; 211/40, 41.12, 169; 312/901, 9.55, 9.56, 9.58

[56] References Cited

U.S. PATENT DOCUMENTS

| | | | |
|---|---|---|---|
| 4,871,086 | 10/1989 | Davies et al. | 221/90 X |
| 4,893,727 | 1/1990 | Near | 221/90 X |
| 5,588,537 | 12/1996 | Hagopian | 211/169 X |

FOREIGN PATENT DOCUMENTS

| | | | |
|---|---|---|---|
| 5-89345 | 4/1993 | Japan . | |
| 7-57150 | 3/1995 | Japan . | |
| 87/00948 | 2/1987 | WIPO | 194/906 |

*Primary Examiner*—F. J. Bartuska

*Attorney, Agent, or Firm*—Burns, Doane, Swecker & Mathis LLP

[57] ABSTRACT

A vending machine for selling encased recording media such as CDs comprises a control unit and a plurality of vending units connected in tandem. Each vending unit is comprised of holders for holding encased CDs. The encased CDs are held in a way that allows them to be pivoted to left and right about the edge on the opposite side to the edge containing information about the contents. A person wishing to purchase a CD can directly touch the case and swing the case to either side, making it possible to read information on both sides and confirm the contents. An advantage of the configuration of this vending machine is that the number of vending units that are linked together can be adjusted to fit the available installation space or the number of CDs involved.

6 Claims, 8 Drawing Sheets

VENDING MACHINE FOR ENCASED RECORDING MEDIA

FIELD OF THE INVENTION

The present invention relates to an automatic vending machine for encased recording media such as videocassette tapes and compact discs (CDs). The present invention particularly relates to a vending machine for selling encased recording media that has holders for holding the recording media in a way that allows the front, back and sides of the recording media case to be viewed.

BACKGROUND OF THE INVENTION

Various types of vending machine have been devised for selling encased recording media such as videocassette tapes and compact discs. In JP-B 7-57150, for example, the present inventors disclosed a vending machine for selling used encased recording media. In the vending machine thus disclosed, the encased recording media could be manually turned to enable the description of the contents on the front, back and sides to be viewed.

SUMMARY OF THE INVENTION

An object of the present invention is to provide an improved vending machine for encased recording media.

More specifically, an object of the present invention is to provide a vending machine having a structure adapted for selling a large number of encased recording media.

An object of the present invention is also to provide such a vending machine for encased recording media having a compact locking and unlocking mechanism that allows encased recording media to be removed from holders.

An object of the present invention is also to provide such a vending machine that allows encased recording media to be purchased using a credit card or a special membership card.

PREFERRED EMBODIMENT

An embodiment of the vending machine for selling encased recording media such as videocassette tapes, CDs and the like, according to the present invention will now be described, with reference to the drawings.

Figure 1:
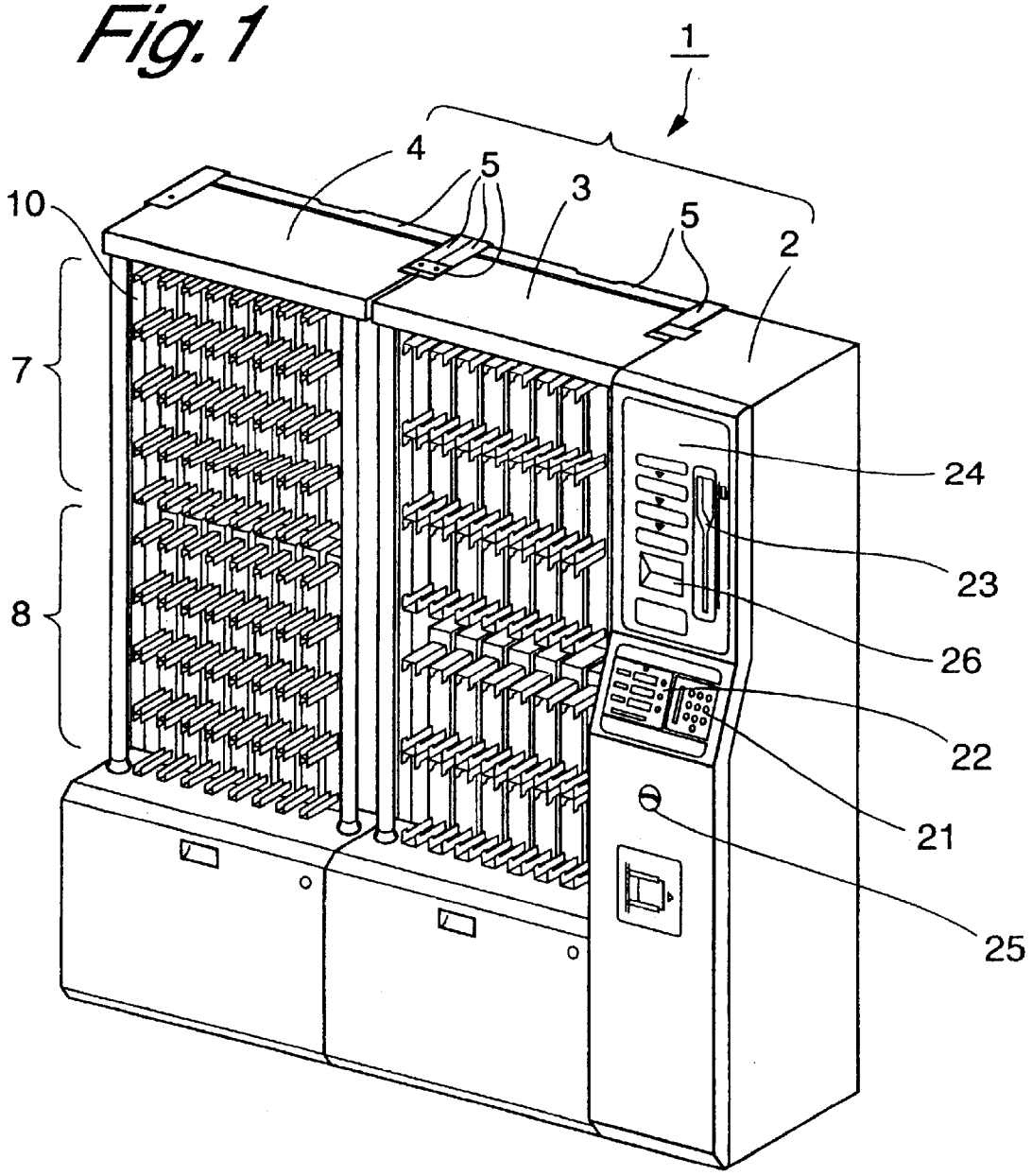
FIG. 1 is a perspective view showing the external aspect of a vending machine for encased recording media that is an embodiment of the present invention.

FIG. 1 is an external perspective view of an embodiment of the vending machine for encased recording media according to this invention. In this embodiment, a vending machine

1 for selling encased recording media comprises a control unit 2, a videocassette tape vending unit 3, a CD vending unit 4, and a connecting bracket 5 for connecting units 2 to 4 together in tandem. Arranged on the front surface of the control unit 2 are an input section 21 having an array of input keys, a liquid-crystal display (LCD) panel 22 for displaying information such as the amount of money that has been inserted, a card slot 23 for a membership card or credit card, a display section 24 for displaying an operating sequence, a coin slot 25, and a bill slot 26 for paper money. The control unit 2 incorporates microcomputer-based control circuitry for controlling the encased recording media vending operations, described below.

The vending units 3 and 4 have the same structure, and differ only in terms of their size, the dimensions of each being based on the size of the encased recording media they are required to house. Thus, while the following description is made with reference to the CD vending unit 4, the described structure also applies to the videocassette tape vending unit 3.

Figure 2:
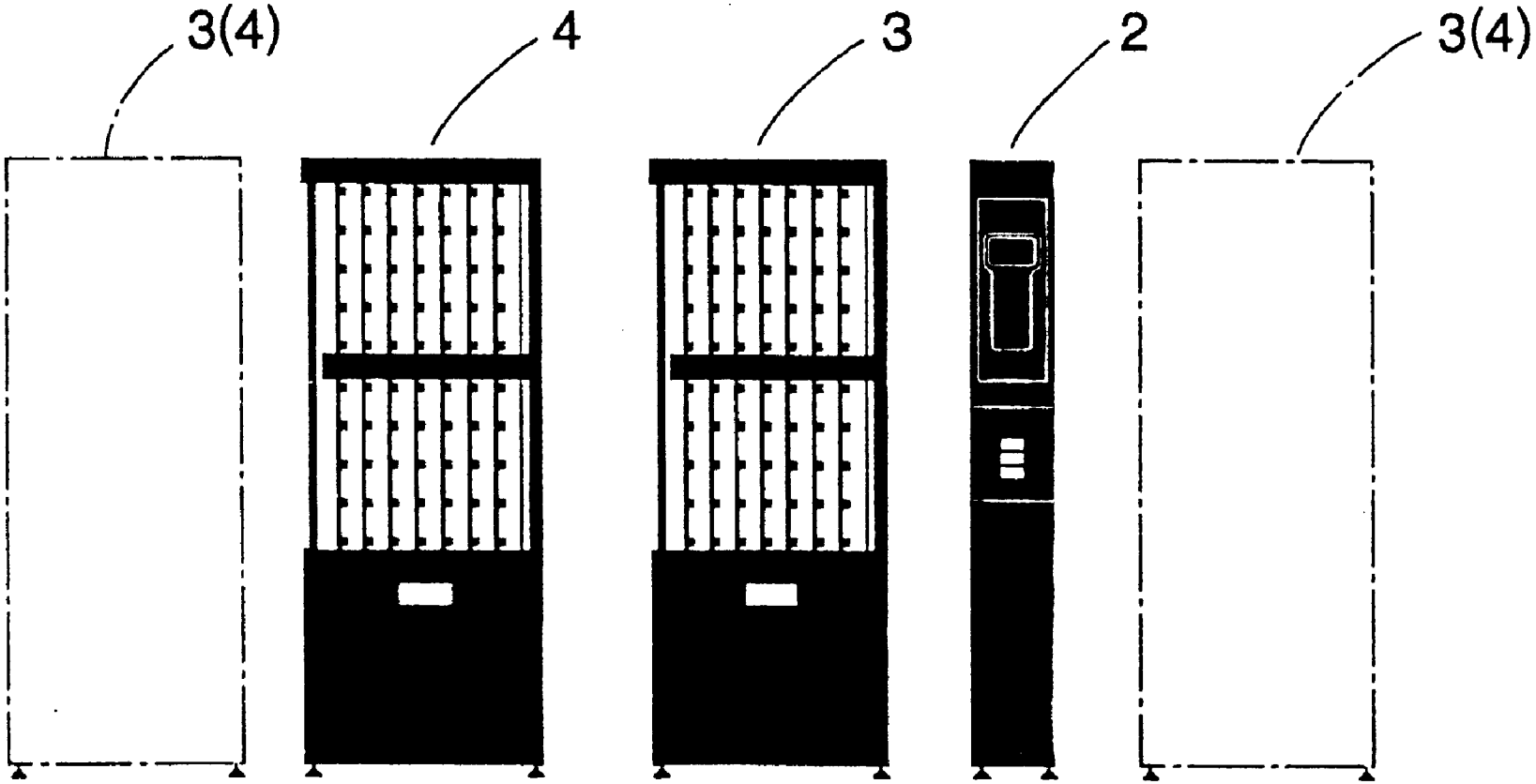
FIG. 2 is a drawing illustrating the unit configuration of the vending machine of FIG. 1.

The vending units 3 and 4 have the same shape. A plurality of such units can be coupled together. Namely, with reference to FIG. 2, units 3 and 4 can be connected together laterally. It is also possible to connect units 3 and 4 at the opposite end to the control unit 2. Since units 3 and 4 are thus standardized, the vending machine can be configured to hold as many encased recording media tapes and/or discs as required by linking together the required number of vending units.

The structure of the vending unit 4 will now be described, with reference to FIGS. 3 to 5. As can be seen from FIG. 1, the CD vending unit 4 has an upper housing 7 and a lower housing 8, each configured to accommodate four rows of CDs. Each of the housings 7 and 8 is comprised of eight rows of identical holders 10.

Figure 3:
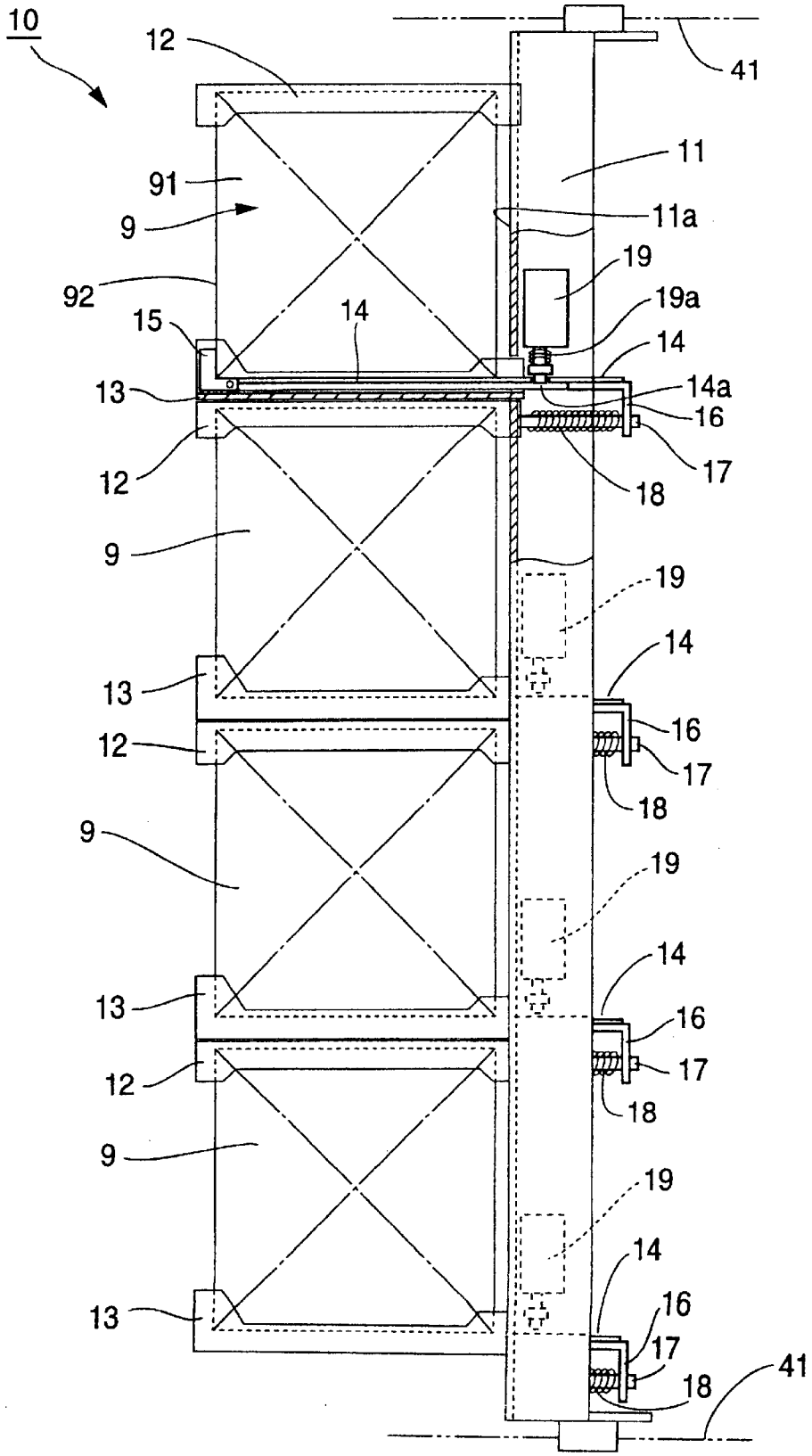
FIG. 3 is a side view of holders of the vending machine of FIG. 1.

As can be seen in FIG. 3, each of the holders 10 includes a vertical frame 11 rotatably supported in unit case 41. An upper frame 12 and a lower frame 13 are attached at their respective rear edges to a front surface 11*a* of the vertical frame 11, from which the upper frame 12 and lower frame 13 extend parallel to each other. In this embodiment, there are four sets of these upper and lower frames 12 and 13.

Figure 4:
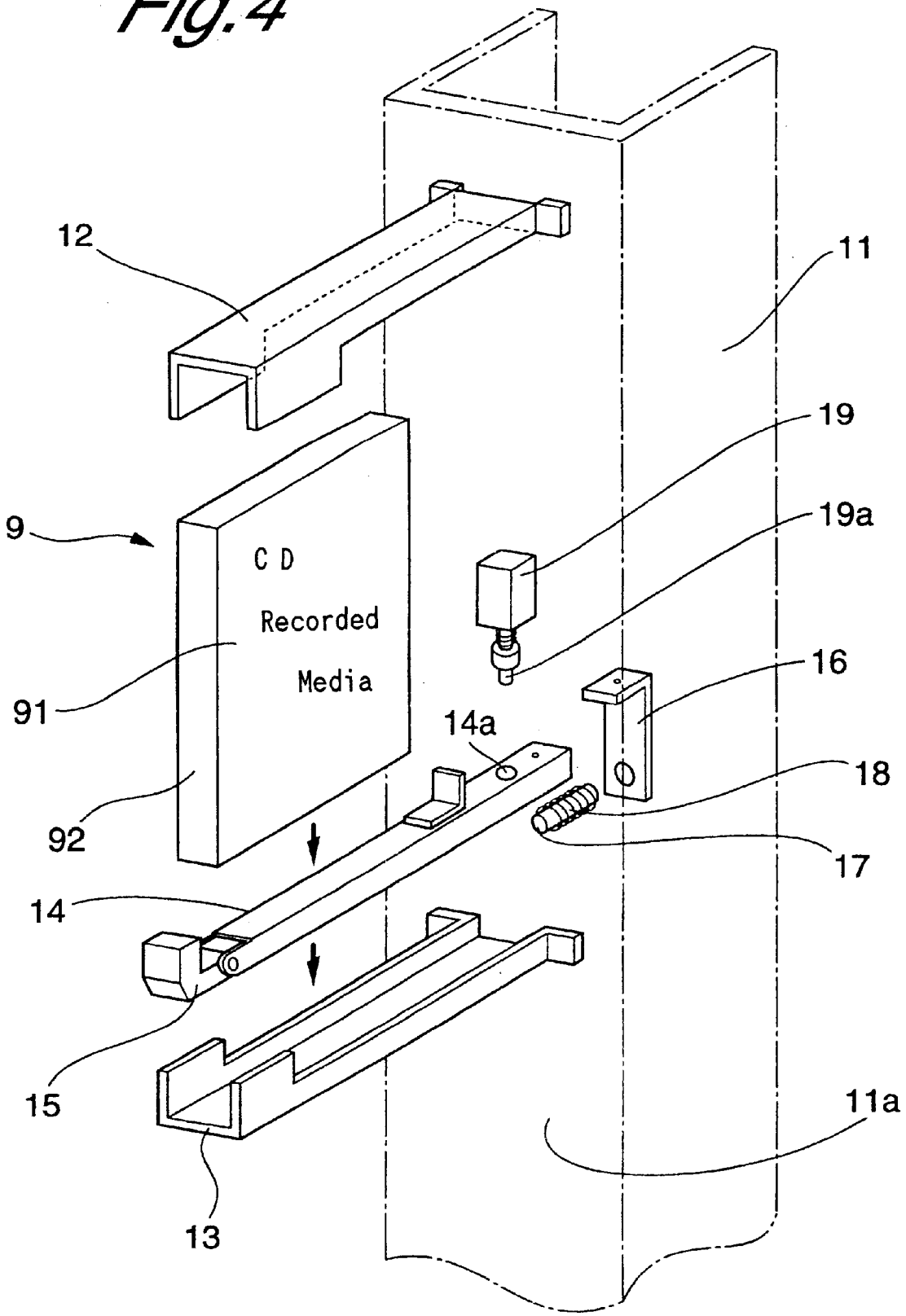
FIG. 4 is an exploded view of the component parts of a holder of FIG. 3.
Figure 5:
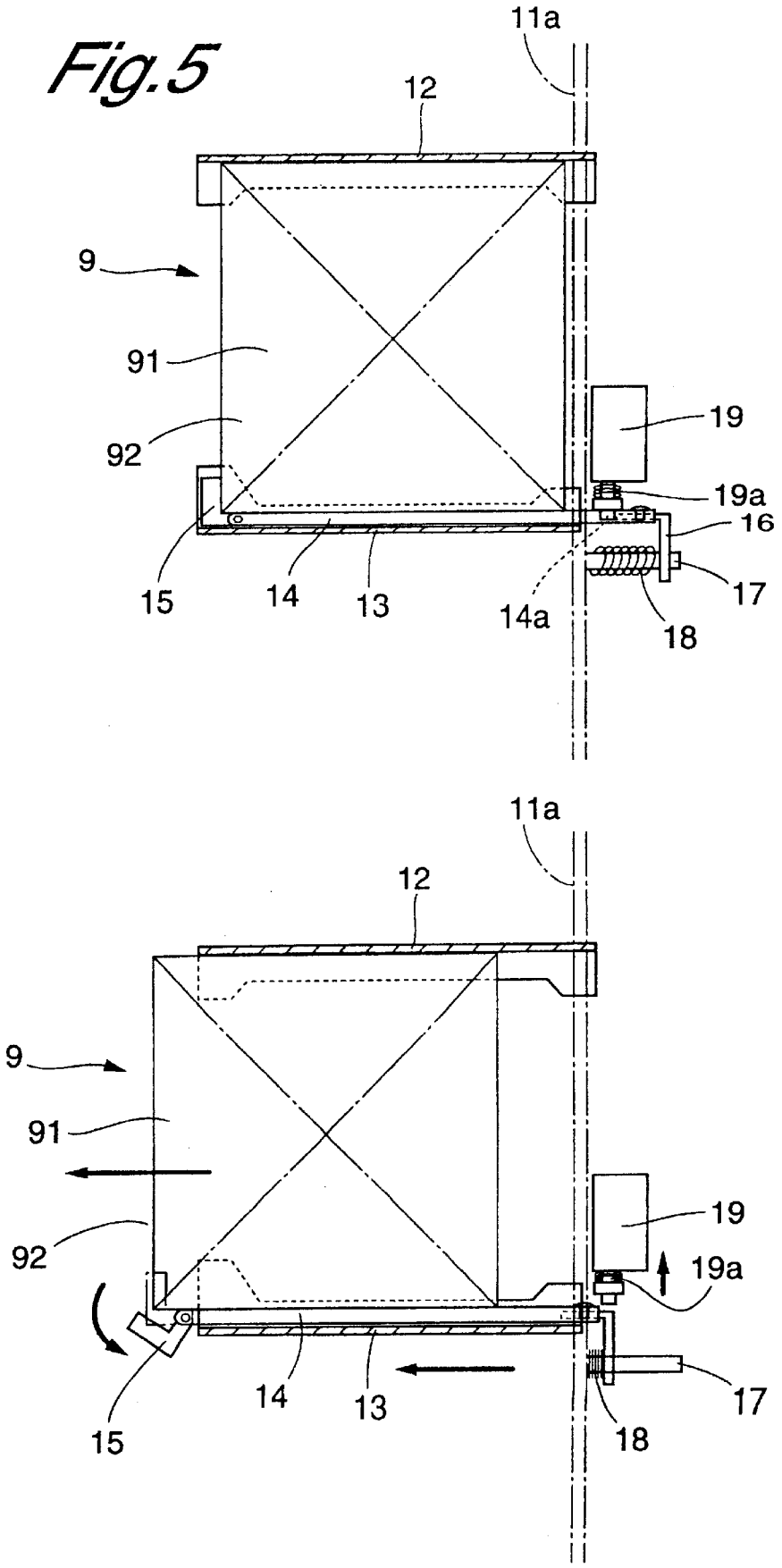
FIG. 5 is a drawing illustrating the operation of removing a CD from the holder.

As shown in FIG. 4, upper frame 12 and lower frame 13 extending horizontally from the vertical frame 11 each have a U-shaped section that opens downward, in the case of the upper frame 12, and upward, in the case of the lower frame 13. Disposed on the upper surface of the lower frame 13 is a slider frame 14 that can be moved freely along the lower frame 13. The front end of the slider frame 14 has a hook 15 that can be pivoted up and down. The hook 15 is an upward, right-angled hook.

Since the slider frame 14 and hook 15 rides on the lower frame 13, an encased CD 9 is held in the machine with the hook 15 in engagement with the lower end of the edge surface 92 of the CD case 91. Thus, the CD 9 is maintained between the upper frame 12 and the lower frame 13, from which removal of the CD 9 is prevented by the hook 15.

The rear end of the slider frame 14 projects out from the rear side of the vertical frame 11. A guide bracket 16 having a downward bend is attached to the rear end of the slider frame 14. The guide bracket 16 has a hole 16*a* for a guide pin 17 that extends horizontally from the rear surface of the vertical frame 11. The guide bracket 16 can be slid along the guide pin 17. Disposed between the guide bracket 16 and the vertical frame 11 is a compression spring 18 that serves to constantly urge the slider frame 14 rearward.

A solenoid 19 is attached to the vertical frame 11 at a position above the rear end portion of the slider frame 14. The actuating rod 19*a* of the solenoid 19 faces downward, and when the solenoid 19 is off, the actuating rod 19*a* is kept extended downward by the force of a coil spring 19*b*. When the actuating rod 19*a* is thus extended, the end of the actuating rod 19*a* locates in an engagement hole 14*a* in the slider frame 14. This prevents the slider frame 14 from being pulled outward, thereby preventing removal of the CD 9.

This is the state shown in FIG. 5(A). In this state, pushing the CD 9 enables the CD 9 to be pivoted sideways about the vertical frame 11, thereby making it possible to read CD content information on the sides.

When the solenoid 19 is switched on, the actuating rod 19*a* is drawn upward against the force of the spring. This disengages the actuating rod 19*a* from the slider frame 14 and enables the slider frame 14 to be drawn out to the front against the force of the coiled spring 18. As shown in FIG. 5(B), the engagement of the hook 15 on the lower front edge of the CD 9 means that drawing the CD 9 out to the front also draws out the slider frame 14 to the front. When the slider frame 14 is drawn to the front so that the hook 15 is drawn completely free of the lower frame 13, the hook 15 pivots down under its own weight. This breaks the engagement between the hook 15 and the CD 9, making it possible to pull out just the CD 9.

Figure 6:
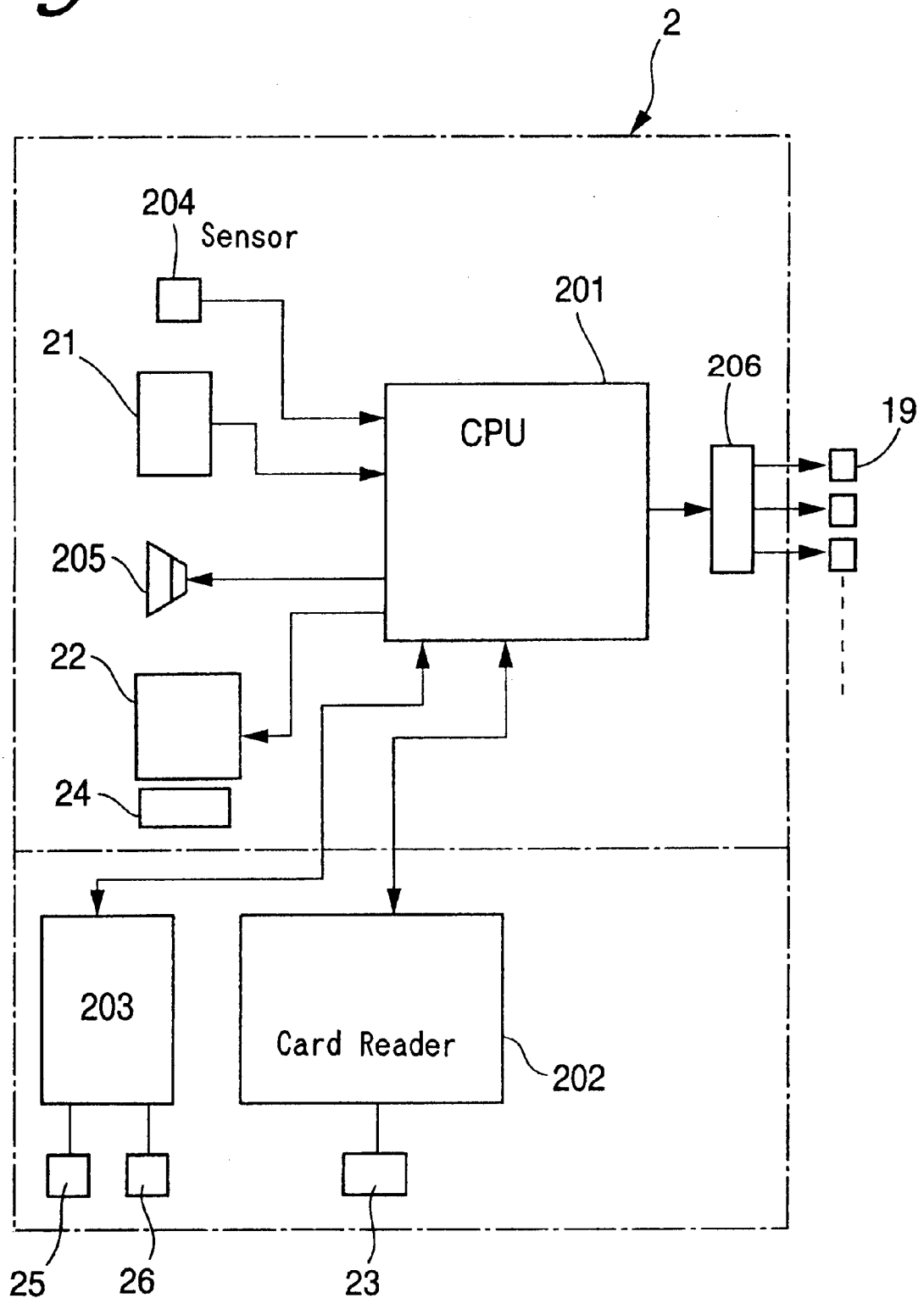
FIG. 6 is a block diagram of the control system incorporated in the control unit of the vending machine shown in FIG. 1.

FIG. 6 is a block diagram of the control system of the vending machine 1 of this embodiment. The circuitry making up the control system is incorporated in the control unit 2. The control system of this embodiment is based on a central processing unit 201 constituted by a microcomputer. The input section 21 with its array of input keys, the LCD panel 22 for displaying the amount of money that has been inserted, a card reader 202 equipped with the card slot 23 for a membership card or credit card, the display section 24 for displaying an operating sequence and a change processor 203 equipped with the coin slot 25 and paper-money bill slot 26 on the front of the control unit 2 are all connected to the central processing unit 201. The central processing unit 201 is also connected with a sensor 204 and a speaker 205 located on the front of the control unit 2 to provide users with spoken operating instructions. The central processing unit 201 is also connected via driver 206 with each of the solenoids 19 in the vending units 3 and 4.

Figure 7:
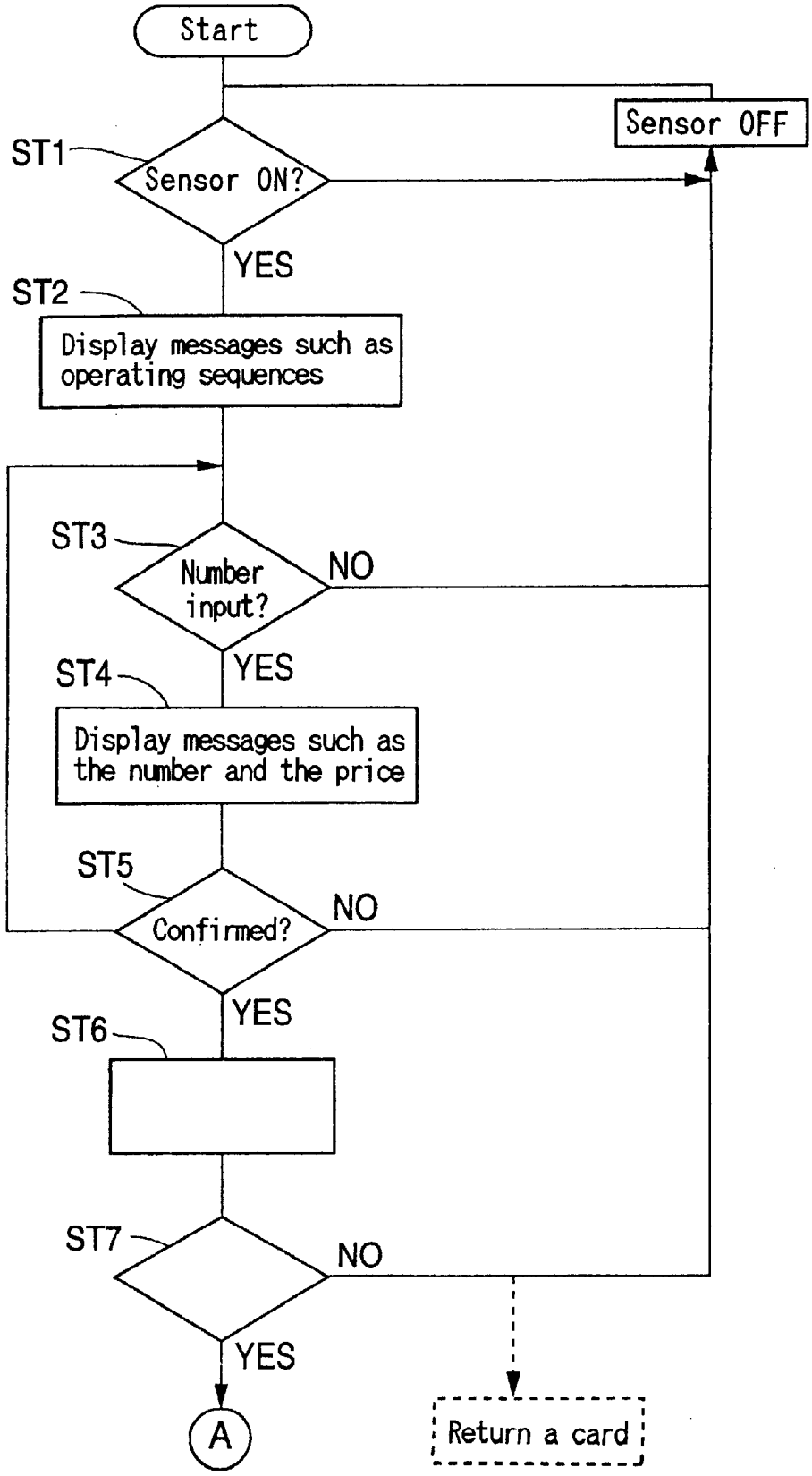
FIGS. 7 and 8 are flow charts of the vending operations of the vending machine of FIG. 1.
Figure 8:
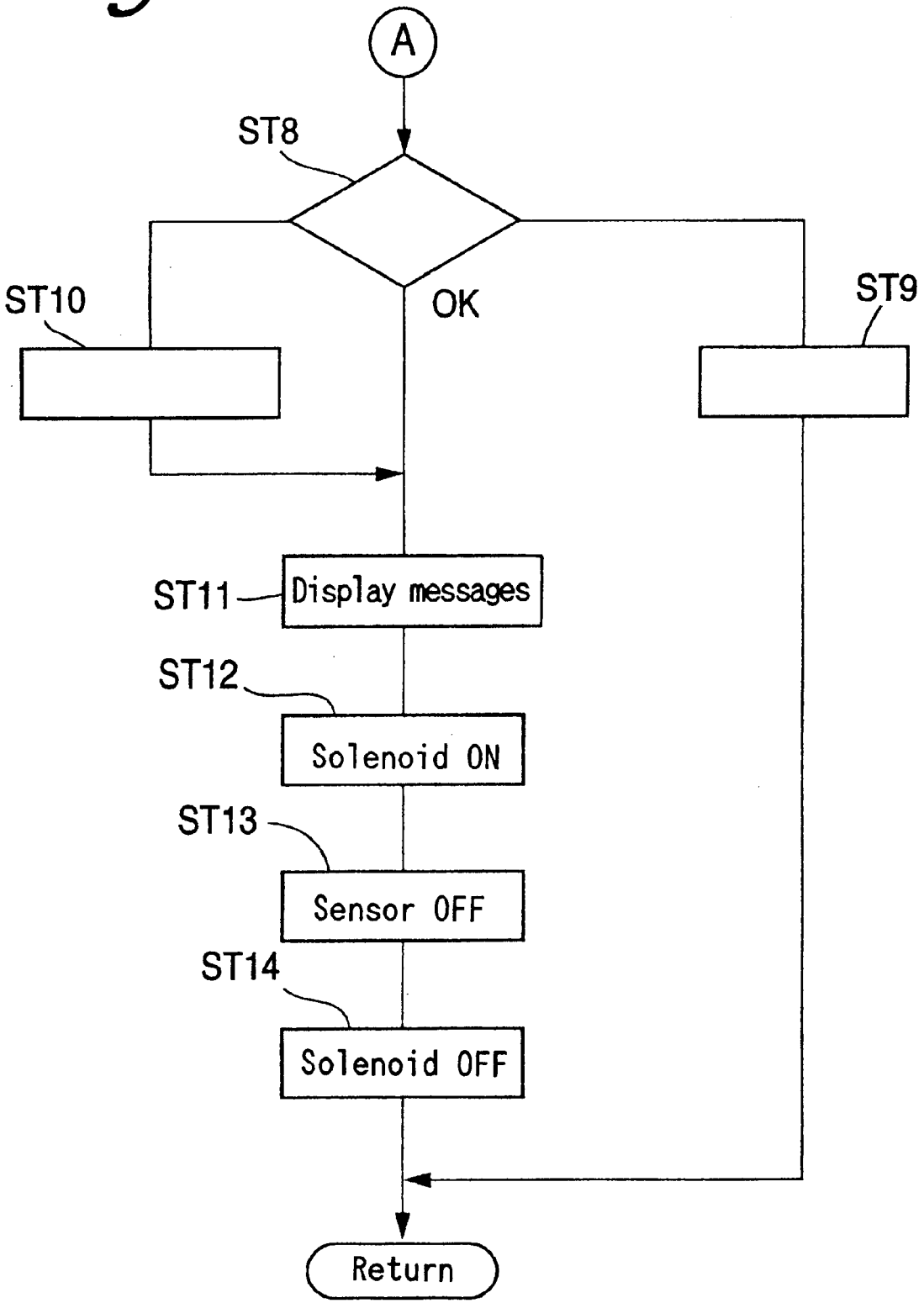

FIGS. 7 and 8 are flow charts showing the operating sequence of the vending machine 1. The operation of selling a CD 9 will now be described, with reference to these flow charts.

First, a customer who stands in front of the vending machine 1 activates the detection sensor 204 (step ST1). The activation of the sensor 204 causes the speaker 205 to issue a spoken prompt, such as, for example, "Welcome! Please input the number of the CD you wish to purchase" (step ST2). The system then waits for the customer to use the keypad of the input section 21 to input the number of the required CD (step ST3). When the number is input it is compared with a reference look-up table stored in the memory section (not shown) of the central processing unit 201, and the price of the corresponding CD is displayed on the LCD panel 22, together with the message, "Please confirm the number," (step ST4).

The system then waits for the customer to confirm the input number by pressing a confirmation button (not shown) on the input section 21 (step ST5). If after a set time there has been no confirmation, the system reverts to its initial state. Or, if the customer uses a correction button (not shown) on the input section 21 to indicate a wish to make a correction to the number, the process reverts to the state preceding the input of the number (step ST3).

When the input number is confirmed, the input number and the cost of the CD are displayed on the LCD panel 22, together with the message, "Please insert the money," (step ST6). The system then waits for the customer to insert the money (step ST7). If after a set time money has not been inserted, the system reverts to its initial state. When money is inserted, the system determines whether or not the required amount has been inserted (step ST8). If the required amount of money is not inserted within a set time, the money that has been inserted to that point is returned (step ST9) and the system reverts to its initial state.

When the required amount of money is inserted within the set time, the message "Thank you. Please take the CD" is displayed (step ST11). If necessary, change is dispensed (step ST10), and a message such as "Please take your change" is displayed. This is followed by the activation of the solenoid 19 of the CD holder number concerned (step ST12). As described above, activating the solenoid 19 makes it possible to remove the CD 9 from the holder. The customer only needs to follow the directions to obtain the required CD 9.

Afterwards, the sensor 204 switches off (step ST13), and, after the elapse of a set time, the solenoid 19 switches off (step ST14). The system then reverts to its initial state.

As explained in the foregoing, with the vending machine 1 according to this invention customers can directly touch a CD case and swivel it to either side, which makes it possible to confirm what the CD contains by referring to the description on each side as well as on the edge. At the same time, the CD is held securely and therefore cannot be stolen.

The vending machine 1 according to this invention uses a change processor 203 to allow cash purchases of CDs, and also allows CDs to be purchased by credit card.

This is done by using the card reader 202 shown in FIG. 6, and including a modem or other such communications capability in the central processing unit 201 to enable a credit card company to check credit card numbers, personal identification code numbers and other data via a communications link.

For such a case, a message such as "Please insert your credit card" could be displayed in the processing of step ST6 of FIG. 7. In step ST7, the necessary credit card information required by the credit card company could be requested to determine whether or not the credit card is valid, and if the card is invalid, it would be returned and the system would revert to its initial state. In step ST8, the customer would be asked to confirm the credit transaction. If after a set time the confirmation was not forthcoming, the process would advance to step ST9 in which the credit card would be returned to the customer. Other than these, the control steps would be the same as in the case of a cash purchase of a CD.

In the case of credit card purchases, it would also be possible to use information on the age of a would-be purchaser, as recorded on the card, to implement controls on sales. For example, it would be possible to prohibit sales of adult CDs to minors. This could also be done using a membership card system to restrict purchases to members only.

Sales of videocassette tapes in the vending unit 3 of the vending machine 1 are implemented using the same vending operations used to sell CDs. In this embodiment, purchases of CDs can be paid for in cash or by credit card. Alternatively, the machine may be configured for cash-only purchases, or, conversely, for purchases by credit card only.

As described in the foregoing, the vending machine according to the present invention allows a prospective customer to touch the encased recording media and flip them to either side. Therefore, the customer can confirm the content by viewing the information on the edge and each side of the media case, and choose accordingly. This is convenient for purchasers. As many vending units of the same shape as required can be is linked together to provide the vending machine of the invention with any capacity required. This makes it possible to readily configure the vending machine by adding or removing units depending on the available installation area.

Moreover, the locking and unlocking mechanism that allows the encased recording media to be removed or not removed is compactly implemented, resulting in overall compactness of the vending units.

The vending machine of the invention offers users further convenience by making it possible to purchase the encased recording media with a credit card. Using a card-based purchasing configuration makes it possible to impose restrictions on sales of the encased recording media based on the age of a would-be purchaser.

We claim:

1. A vending machine for encased recording media, comprising:

a plurality of holders for holding encased recording media in a state that allows the encased recording media to be touched and pivoted to either side about a rear edge portion, a mechanism that can be switched between a locked state that prevents removal of encased recording media and an unlocked state that allows removal of encased recording media, an input section that enables any holder to be specified, a control section that controls the locking and unlocking mechanism based on information input via the input section and processes vending of encased recording media in the holders, wherein it has vending units provided with said plurality of holders, a control unit provided with said input section and control section, and linking means for linking together unit cases of the vending units and the control unit, each vending unit has a unit case, a shaft having upper and lower ends rotatable supported in the unit case, and a plurality of holders attached to the shaft, in which each holder has an upper frame and a lower frame attached at their rear ends to the shaft from which the upper frame and lower frame extend in parallel, a slider frame that can be moved along the surface of the lower frame and is provided at its front end with a hook that can be pivoted up and down, said locking and unlocking mechanism that can lock the slider frame at a retracted position at which the hook does not project from a front edge of the lower frame, and a spring whereby the slider frame and hook are urged to a position of full retraction, wherein when the locking and unlocking mechanism is in an unlocked state the slider frame can be drawn out to a position at which the hook pivots down under its own weight, disengaging from the lower front edge of the encased recording media and thereby allowing the encased recording media to be drawn out from between the upper and lower frames.

2. A vending machine for encased recording media according to claim 1, wherein the vending machine has a plurality of vending units that can be connected in tandem with the control unit by the linking means.

3. A vending machine for encased recording media according to claim 1 in which the locking and unlocking mechanism is provided with a solenoid, wherein when the solenoid is in an off state the solenoid actuating rod is maintained by spring force in engagement with the slider frame at the retracted position, and when the solenoid is switched to an on state the actuating rod retracts to a position of disengagement from the slider frame.

4. A vending machine for encased recording media according to claim 1, wherein the control section has a card reader that can read a credit card or a membership card and can allow or disallow sale of encased recording media based on information read from the card, and processes payments for encased recording media.

5. A vending machine for encased recording media according to claim 4, wherein the control section detects a cardholder's age based on information read from the card and based on the age thus detected determines whether to allow or disallow sale of the encased recording media to that person.

6. A vending machine for encased recording media according to claim 1, wherein the control section has a card reader that can read a credit card or a membership card and can allow or disallow sale of encased recording media based on information read from the card, and processes payments for encased recording media.

* * * * *